United States Patent [19]

Ottieri

[11] Patent Number: 4,696,117

[45] Date of Patent: Sep. 29, 1987

[54] SPRING STRUCTURE FOR SKI BOOT

[76] Inventor: Marco T. Ottieri, 148 Bridge St., Manchester, Mass. 01944

[21] Appl. No.: 917,910

[22] Filed: Oct. 10, 1986

[51] Int. Cl.[4] ..... A43B 5/04

[52] U.S. Cl. ..... 36/117; 36/121

[58] Field of Search ..... 36/117–121

[56] References Cited

U.S. PATENT DOCUMENTS

| | | | |
|---|---|---|---|
| 4,476,640 | 10/1984 | Aldinio et al. . | |
| 4,523,395 | 6/1985 | Borsoi | 36/119 |
| 4,565,017 | 1/1986 | Ottieri | 36/117 |

FOREIGN PATENT DOCUMENTS

| | | | |
|---|---|---|---|
| 0132705 | 2/1985 | European Pat. Off. | 36/117 |
| 2340622 | 4/1974 | Fed. Rep. of Germany . | |
| 3529209 | 2/1986 | Fed. Rep. of Germany | 36/117 |
| 2555418 | 5/1985 | France | 36/117 |

*Primary Examiner*—James Kee Chi

*Attorney, Agent, or Firm*—Lahive & Cockfield

[57] ABSTRACT

A spring structure for a ski boot includes a leaf spring element overlying the instep and shin cuff elements of the boot. The spring is affixed at its lower end to the toe element, hingedly mounted at an intermediate portion to a hinge pin affixed to the shin cuff, and coupled at its upper end to the shin cuff, preferably by an elastic strap. The lower portion of the spring structure is bowed inward and downward so that as the hinge pin moves forward in response to forward lean, the lower portion of the spring flexes inward and downward. The inward flexing of the lower portion of the spring produces a torque about the hinge pin and urges the upper portion of the spring to deflect outward. This outward deflection is resisted by the coupling of the upper spring end of the cuff, causing the upper portion to deflect concavely outward so that the spring assumes an "S" shape. The spring geometry provides a rising rate spring and prevents the top of the spring from contacting the shin of the wearer. The spring structure preferably includes a provision for adjustably preloading the upper coupling.

9 Claims, 3 Drawing Figures

SPRING STRUCTURE FOR SKI BOOT

BACKGROUND OF THE INVENTION

This invention relates to ski boots. More particularly it provides a ski boot having a spring structure for varying the forward flex response of the boot to accommodate the requirements of the user. Ski boots have in recent years employed a variety of structures to provide various degrees of stiffness, flexibility and adjustment. The following U.S. patents illustrate recent developments in ski boot structures.

U.S. Pat. No. 3,609,887 Hickman et al
U.S. Pat. No. 3,686,778 Horning
U.S. Pat. No. 3,713.231 Mochizuki
U.S. Pat. No. 3,775,872 Rathmell
U.S. Pat. No. 3,844,055 Koyama
U.S. Pat. No. 3,861,067 Koyama et al
U.S. Pat. No. 3,945,134 Ramer
U.S. Pat. No. 4,095,356 Robran et al
U.S. Pat. No. 4,160,332 Salomon
U.S. Pat. No. 4,190,970 Annovi
U.S. Pat. No. 4,196,530 Delery
U.S. Pat. No. 4,222,184 Kastinger
U.S. Pat. No. 4,338,735 Spademan
U.S. Pat. No. 4,461,103 Annovi
U.S. Pat. No. 4,470,206 Annovi
U.S. Pat. No. 4,565,017 Ottieri There exists a need for a ski boot which allows limited compliance for the skier's initial forward lean together with adjustable and progressively stiffer flex response to increasing lean so as to provide both comfort and responsiveness to skier input.

It is accordingly an object of the present invention to provide a ski boot spring structure which is user adjustable to suit preference and varying terrain. It is a further object of the invention to provide a rising rate spring structure, rather than a constant rate spring structure.

GENERAL DESCRIPTION

A ski boot according to the present invention has a foot receiving base element that provides sole, toe, and instep portions and mounts a shin cuff element. The boot has the feature of a leaf spring structure overlying the instep and cuff portions of the boot. The spring is affixed at its lower end to the toe portion, hingedly mounted at an intermediate portion to a hinge pin affixed to the shin cuff, and coupled at its upper end to the shin cuff. An elastic strap is one preferred means for coupling. The lower portion of the spring structure is concavely bowed downward so that as the hinge pin moved forward in response to forward lean the lower portion of the spring flexes inward and downward.

This downward concave flexing of the lower portion of the spring produces a torque about the hinge pin and urges the upper portion of the spring to deflect outward. The spring has locally increased stiffness in the area proximate to the hinge pin and thereby bears pivoting loads. Outward deflection of the upper portion of the spring is resisted by the coupling of the upper end of the spring to the cuff, thus causing the upper portion to concavely bow out so that the spring assumes an "S" shape. It will be apparent that the tension and the elastic modulus of the coupling directly affect forward flex response of the boot. A provision for adjusting the preloaded tension of the coupling is preferably incorporated so that the skier can vary the stiffness of the boot.

It will also be apparent that because of the offset between the hinge points of the shin cuff and the spring, the upper portion of the spring has a shorter pivot radius than does the shin cuff. Accordingly, as forward lean increases the shin cuff moves forward, the upper end of the spring moves forward at a faster rate, and the gap between the top of the shin cuff and the upper end of the spring would increase if not restrained by the coupling. The result of this spring configuration is a rising rate spring rather than a constant rate spring. That is, for each incremental increase in lean angle, stiffness of the boot increases at a rising rate. The advantage of a rising rate spring over a constant rate spring is that a soft initial response is provided for comfort and an increasingly stiffer response is provided for control during aggressive skiing.

The spring geometry of the invention also prevents the top of the spring from biting into the sensitive shin area under forward lean, a problem referred to in the prior art as "shin bite."

The invention accordingly comprises features of construction, combinations of elements and arrangements of parts exemplified in the constructions hereinafter set forth and the scope of the invention is indicated in the claims.

BRIEF DESCRIPTION OF DRAWINGS

For a fuller understanding of the nature and object of the invention reference should be made to the following detailed description and the accompanying drawings in which.

FIG. shows force to deflection curves for a rising rate spring similar to that of the invention and for a constant rate spring.

Figure 3:
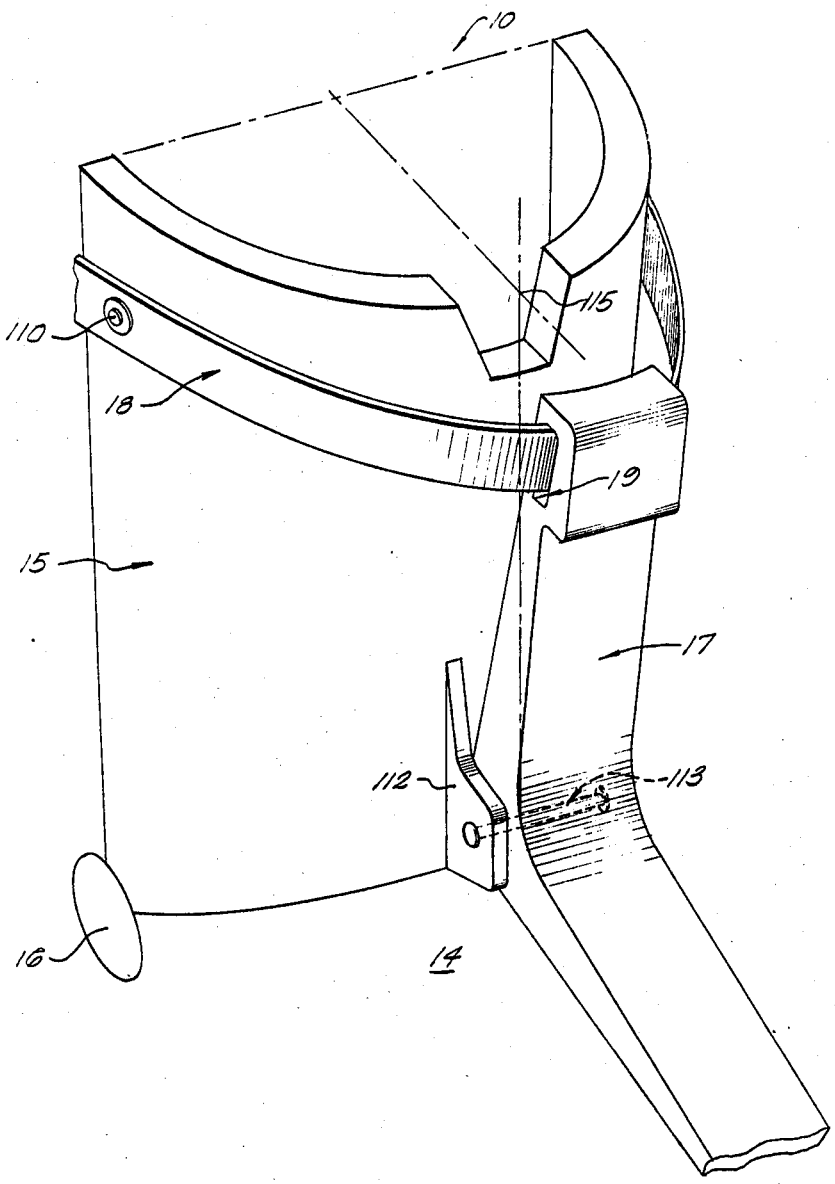

FIG. 3 is a fragmentary front elevation view of another boot according to the invention.

DESCRIPTION OF ILLUSTRATED EMBODIMENTS

Figure 1:
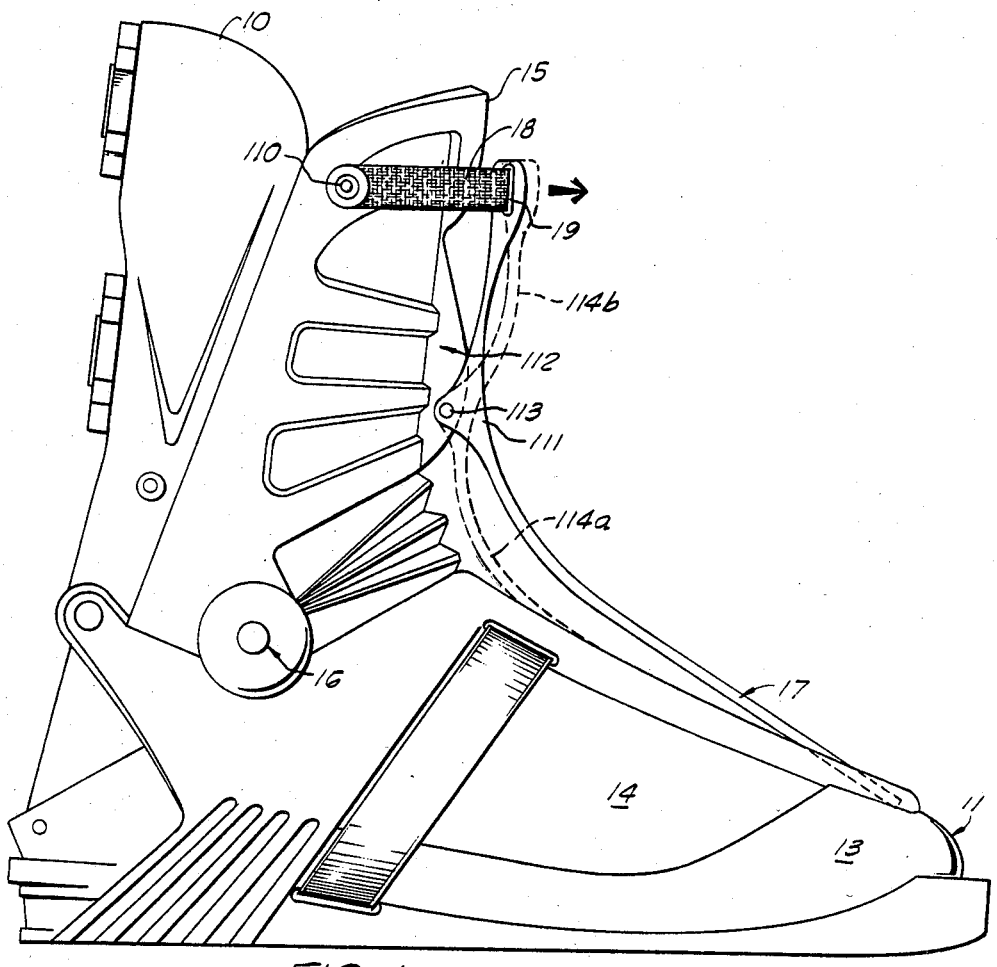
FIG. 1 is a side elevation view of a boot according to the invention.

Referring to FIG. 1, a ski boot 10 according to one embodiment of the invention has a base element 11 having sole 12, toe 13 and instep 14 regions. A leg cuff 15 is hingedly affixed to base element 11 by hinge 16. A concavely curved leaf spring structure 17 overlies the instep 14 and cuff 15 regions of boot 10. Spring 17 is affixed at its lower end to base 11 and coupled to its upper end to cuff 15 by strap 18 which passes through slot 19 in spring 17. Strap 18 may be formed of any pliable material, such as elastic. Strap 18 is in turn affixed to cuff 15 by fasteners 110. An intermediate portion of spring 17 may be creased to form a reinforcing flange 111 which engages raised boss 112 on cuff 15. Flange 111 and boss 112 are provided with a through hole, and hinge pin 113 hingedly engages flange 111 to boss 112.

When the skier leans forward, cuff 15, boss 112 and hinge pin 113 move forward, causing spring 17 to flex inward and downward, to the position shown in phantom as 114*a*. The inward flexing of 114*a* causes a torque about hinge pin 113 and in turn, because of the stiffness imparted by flange 111, the upper part of spring 17 deflects outward, away from cuff 15. Because the upper end of spring 17 is restrained by strap 18, the upper part of spring 17 assumes the convex shape shown in phantom as 114*b*. Spring 17 is curved so that in its normal free state its upper end tends to be distal from cuff 15.

Tightening of strap 18 brings the upper end of spring 17 toward cuff 15, preloading spring 17. Adjusting the tension in strap 18 accordingly varies lean control, and a means for adjusting preloaded tension, such as by a releasable clasp mechanism known in the art, is preferably provided. Such a provision would allow the skier to adjust lean control to suit comfort preference or various terrain conditions.

It will be apparent that the elastic modulus of strap 18 directly affects the spring force of the boot. A very flexible strap may be provided for skiers desirous of a comfortable, soft response, while a high modulus strap may be installed for skiers seeking maximum lean control. Alternatively, a strap may be employed which is elastic within a particular elongation range, and inelastic beyond that range.

Another preferred embodiment utilizes a rigid coupling which permits the upper end of spring 17 a limited amount of free forward travel, and then prevents additional travel.

Because of the offset between the hinge points of shin cuff 15 and spring 17, the upper portion of spring 17 has a shorter pivot radius than does shin cuff 15. As a result of this and of the leverage between upper and lower portions of spring 17, the forward deflection of the upper end of spring 17 is greater than the forward deflection of cuff 15 during forward lean. The gap between the upper end of spring 17 and shin cuff 15 would increase if the upper end of spring 17 is not restrained. Restraining the upper end of spring 17 results in a rising rate or progressive spring because incremental deformation and energy storage in the upper portion increases with each increment of lean angle.

Figure 2:
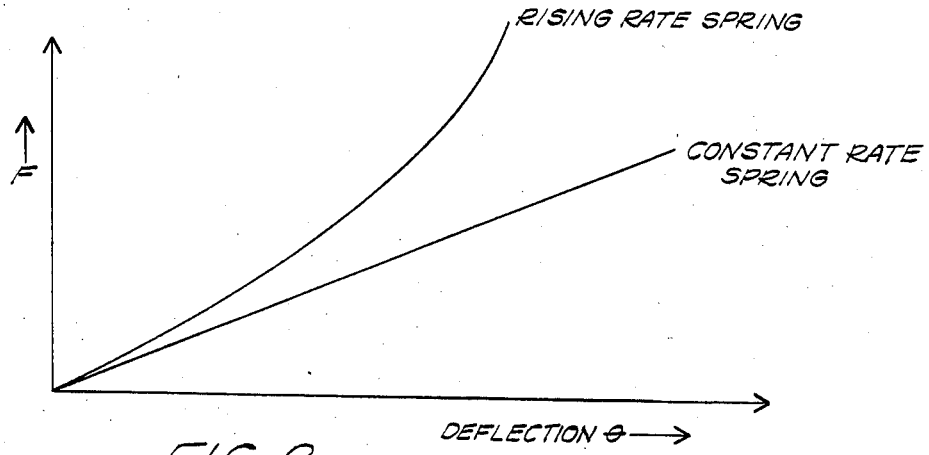

FIG. 2 shows the force to deflection response of rising rate and constant rate springs. For clarity, only one rising rate spring curve is shown. However, because of the adjustable preload of the invention, the response of the spring 17 could be plotted as a family of increasing-slope curves. The rising rate spring of the invention provides soft response to initial forward lean and stiff response to large lean angles for maximum control during aggressive skiing.

The force to deflection characteristics of the coupling device will affect progressivity of the spring structure. A non-flexible strap or rigid coupling which does not permit free travel will accentuate progressivity, while a highly flexible or low-tension strap, or rigid coupling which permits some free travel, will produce an overall force to deflection curve having a constant slope for small lean angles. This is attributable to the fact that as long as the upper end of spring 17 is uncoupled the lower portion of spring 17 will generate only linear force to deflection response.

Moreover, because the strap of other coupling cooperates with the upper portion of the spring to determine lean control, either the upper portion of the spring, the strap, or both could be chosen to be elastic, depending upon the desired response characteristics.

A preferred embodiment of the invention utilizes a strap 18 which is flexible up to a point in its travel, and then prevents further deflection. The preferred spring/strap combination thereby exhibits a degree of hysteresis which prevents snap back, a sudden release of energy when the skier's forward lean decreases.

FIG. 3 is a fragmentary front elevation view of a further preferred embodiment of the invention, in which a "V" shaped cut 115 is provided in the shin cuff 15. V-cut 115 relieves pressure on the shin during extreme forward lean. The utilization of a pressure-relieving V-cut in conjunction with a spring structure is enabled by the configuration of the spring structure, which mainntains a gap between the upper end of spring 17 and the top of cuff 15, thereby obviating the possibility of shin bite.

Those practiced in the art will appreciate that numerous of the features shown can be used independently of others and in a variety of ski boot forms and structures. It will thus be seen that a ski boot according to the invention efficiently attains the object set forth above among those made apparent from the preceding description. Since changes may be made in the illustrated ski boot without departing from the scope of the invention, all matter contained in the above description or shown in the accompanying drawing is to be interpreted as illustrative and not in a limiting sense.

The following claims are intended to cover all of the generic and specific features of the invention described herein and all statements of the scope of the invention which as a matter of language might be said to fall therebetween.

Having described the invention, what is claimed as new and secured by Letters Patent is:

1. In a ski boot having a base element providing at least sole, toe, and instep portions, means forming a leg cuff hingedly secured to said base element for supportingly engaging at least the calf and shin of a wearer, a forward lean control element coupled between said base element and said cuff, said forward lean control element including elongate resiliently-flexing spring means having an intermediate portion joining first and second end portions, coupling means on said cuff for coupling said first end portion of said spring means to said cuff, and coupling means for coupling said second end portion of said spring means to said toe portion the improvement comprising hinge means for hingedly connecting said intermediate portion of said spring means to said cuff, so that a first portion of said spring means resiliently flexes between said first end portion and said hinge means, and a second portion of said spring means resiliently flexes between said hinge means and said second end portion.

2. In a ski boot according to claim 1, the further improvement in which

A. said spring means is curved so that said first end portion tends normally to be distal from said cuff, and B. said coupling means on said cuff comprises means for resiliently displacing said first end portion out of said normal position toward said cuff.

3. In a ski boot according to claim 2, the further improvement comprising adjustment means for adjusting tension in said displacing means.

4. In a ski boot according to claim 3, the further improvement in which said displacing means comprises strap means.

5. In a ski boot according to claim 4, the further improvement

A. in which said hinge means comprises a hinge pin,

B. said spring means comprises a raised reinforcing flange section along said intermediate portion, having a transverse aperture sized to admit said hinge pin, and C. said cuff comprises a raised boss engaging said flange section, having a transverse aperture sized to admit said hinge pin, D. so that said hinge pin hingedly affixes said flange section to said boss.

6. In a ski boot according to claim 5, the further improvement in which said first end portion comprises a slot-like aperture for engaging said strap means.

7. In a ski boot having a base element providing at least sole, toe, and instep portions, means forming a leg cuff hingedly secured to said base element for supportingly engaging at least the calf and shin of a wearer, a forward lean control element coupled between said base element and said cuff, said forward lean control element including elongate resiliently-flexing spring means having an intermediate portion joining first and second portions, the improvement in which said first portion is resiliently deformable convexly and said second portion is resiliently deformable concavely, so that under load said spring means assumes an "S" shape in side view.

8. In a ski boot according to claim 7, the further improvement comprising hinge means for hingedly connecting said intermediate portion of said spring means to said cuff.

9. In a ski boot according to claim 1, the further improvement wherein said first portion of said spring means and said second portion of said spring means deflect oppositely.

* * * * *

UNITED STATES PATENT AND TRADEMARK OFFICE

CERTIFICATE OF CORRECTION

PATENT NO. : 4,696,117

DATED : September 29, 1987

INVENTOR(S) : Marco Tonci Ottieri

It is certified that error appears in the above-identified patent and that said Letters Patent is hereby corrected as shown below: On The Title Page:

In the Abstract:

Line 15, "of" should be --to--.

In the Specification:

Column 1, line 53, "moved" should be --moves--;

Column 2, line 5, after "increases" insert --and--;

Column 2, line 34, after "FIG." insert --2--;

Column 3, line 54, "of" should be --or--;

Signed and Sealed this

First Day of November, 1988

*Attest:*

DONALD J. QUIGG

*Attesting Officer*

*Commissioner of Patents and Trademarks*